US012478199B2

(12) United States Patent
Bury et al.

(10) Patent No.: US 12,478,199 B2
(45) Date of Patent: Nov. 25, 2025

(54) COVER, CONTAINER COMPRISING A COVER, AND METHOD FOR ASSEMBLING A COVER

(71) Applicant: Bury Sp. z o. o., Mielec (PL)

(72) Inventors: Andrzej Bury, Mielec (PL); Henryk Bury, Löhne (DE); Wojciech Sucharzewski, Osiek (PL)

(73) Assignee: BURY SP. Z.O.O., Mielec (PL)

( * ) Notice: Subject to any disclaimer, the term of this patent is extended or adjusted under 35 U.S.C. 154(b) by 14 days.

(21) Appl. No.: 18/034,150

(22) PCT Filed: Oct. 14, 2021

(86) PCT No.: PCT/EP2021/078489
§ 371 (c)(1),
(2) Date: Apr. 27, 2023

(87) PCT Pub. No.: WO2022/089952
PCT Pub. Date: May 5, 2022

(65) Prior Publication Data

US 2023/0389736 A1 Dec. 7, 2023

(30) Foreign Application Priority Data

Nov. 2, 2020 (DE) ..... 10 2020 128 769.0

(51) Int. Cl.
*A47G 19/26* (2006.01)

(52) U.S. Cl.
CPC ..... *A47G 19/26* (2013.01)

(58) Field of Classification Search
CPC ..... A47G 19/26; A47G 19/265; A47G 2023/069; A47G 23/0633; B65F 1/16
(Continued)

(56) References Cited

U.S. PATENT DOCUMENTS 1,995,059 A * 3/1935 Grange ..... B41J 29/13 312/208.3
2,080,786 A 5/1937 Robles
(Continued)

FOREIGN PATENT DOCUMENTS

EP 0423480 B1 5/1993
GB 2518814 * 4/2015
WO WO-2005016793 A1 * 2/2005 ..... B65F 1/06

OTHER PUBLICATIONS

International Search Report from corresponding International Patent Application No. PCT/EP21/78489, dated Feb. 2, 2022.

*Primary Examiner* — Rafael A Ortiz
(74) *Attorney, Agent, or Firm* — RENNER, OTTO, BOISSELLE & SKLAR, LLP

(57) ABSTRACT

The invention relates to a cover for temporarily shielding objects that may be converted from an open state exposing the object to a closed covering state covering the object and vice versa. The invention further relates to a container including such a cover and to an assembly method for such a cover. In order to provide a cover with better handling and reduced footprint, it is proposed that the cover comprises at least two modular interconnectable or interconnected curved screen segments that are at least pairwise movable about a common pivot axis relative to each other when interconnected, wherein the screen segments, in the open state of the cover, are covering each other and, in the covering state of the cover, overlap each other, abut against each other, or are spaced apart from each other such that they form an domed cover. The result is a cover that is adaptable to various purposes and requirements.

10 Claims, 11 Drawing Sheets

(58) Field of Classification Search
USPC ..... 220/574, 4.26, 4.32, 8, 23.2, 820, 821, 220/822, 854, 816, 826, 9.2, 212.5
See application file for complete search history.

(56) References Cited

U.S. PATENT DOCUMENTS

| | | | | |
|---|---|---|---|---|
| 2,250,729 | A | 7/1941 | Smith et al. | |
| 3,229,846 | A * | 1/1966 | Katz | B65F 1/16 220/252 |
| 5,542,560 | A * | 8/1996 | Gerster | A47G 19/26 220/252 |
| 7,624,705 | B2 * | 12/2009 | Plante | A01K 1/03 119/474 |
| 9,624,718 | B2 * | 4/2017 | Geller | A47B 13/00 |
| 2009/0272737 | A1 * | 11/2009 | Vinnicombe | A47J 36/027 220/254.1 |
| 2013/0043243 | A1 * | 2/2013 | Shifferaw | G06F 1/1628 220/8 |
| 2016/0032644 | A1 * | 2/2016 | Geller | E06B 9/24 29/434 |
| 2016/0121914 | A1 * | 5/2016 | Fodrocy | B62B 3/005 280/47.34 |
| 2016/0183731 | A1 * | 6/2016 | Merkazy | A45B 11/00 220/574 |

* cited by examiner

COVER, CONTAINER COMPRISING A COVER, AND METHOD FOR ASSEMBLING A COVER

FIELD OF THE INVENTION

The invention relates to a cover for temporarily shielding objects that may be converted from an open state exposing the object to a closed covering state covering the object and vice versa. The invention further relates to a container including such a cover and to an assembly method for such a cover.

BACKGROUND OF THE INVENTION

From professional and private daily life, covers for various purposes are known that ensure temporary protection of objects, for example, from environmental conditions, unauthorized access, or to screen them from view. In the food industry, for example, hoods and lids for temporarily covering food are available for storing or for serving food in restaurants, in order to protect the food from humidity, light, and insects, or to keep prepared food hot or cold. In addition, everyday objects and articles of value, such as jewelry, wristwatches or keys may be protected from the environment or visual detection by means of an appropriate cover.

Commonly obtainable covers are available in a variety of different shapes, sizes, and materials, which leads to an extensive stock of different models and types of covers in private households and in industrial settings, in order to utilize them for various shielding purposes. The associated necessary footprint is usually considered to be disadvantageous. Furthermore, known covers may be difficult to handle, because, in order to convert a cover to its open position to expose the object, for example, it is necessary to lift the cover off completely and set it down in a convenient location and pick it up from there again, in order to arrange the cover for storage or replace it on top of the object.

SUMMARY OF THE INVENTION

In accordance with an aspect of the invention, a cover is provided with improved handling and reduced footprint as well as a corresponding container comprising said cover. In addition, a simple and intuitive method for assembling the cover is provided.

A cover is proposed, comprising at least two modularly interconnectable or interconnected curved screen segments that are at least pairwise movable about a common pivot axis relative to each other when interconnected, wherein the screen segments, in the open state of the cover, are covering each other and, in the covering state of the cover, overlap each other, abut against each other, or are spaced apart from each other side by side such that they form a domed cover.

The result is a cover that is adaptable for various purposes and requirements. Furthermore, the cover may remain at its point of use near the object and may be converted from its open state to its covering state and vice versa by moving the screen segments relative to each other without having to lift the cover completely off the object or the object support surface. This leads to a reduced footprint due to the modularity of the screen segments and improved handling due to their relative maneuverability.

In the present application, the term cover refers to such a shielding component, which may, for example, form a closure or seal for a container accommodating an object in the sense of a lid. However, irrespective of whether there is a container present or not, the cover may also form a screen component like a dome or hood for an object placed underneath the cover by positioning the cover over said object. To do so, in the covering state, the cover is supported, for instance, at its lower edge by the object support surface where the object is placed. The cover may have a continuous, closed covering surface. The cover may have a discontinuous covering surface that is provided with openings on purpose or due to its design.

The screen segments cover each other in the open state of the cover. In particular, the screen segments may cover each other in a parallel manner in the open state of the cover. Advantageously, the screen segments cover each other completely or almost completely in the open state of the cover, such that the shielding surface formed by the cover is substantially reduced to the screen surface of one screen segment and the object is exposed. Thus the screen segments do not only overlap in their peripheral regions, but cover each other to a large extent of their surface area, for example, at least 50% or at least 75% of the screen surface areas of the screen segments cover each other. Here, a large part of the surface area of a screen segment, for example 50% or 75%, may cover the surface area of an adjacent or connected screen segment. In the covering state of the cover, the screen segments are arranged side by side, whereby in this state, the screen segments may overlap each other, may abut each other or be spaced apart from each other, and form a domed cover. The overlap of the screen segments in the covering state may be minimal, for example, the screen surface areas may overlap each other to an extent of less than 50% or less than 25%. The overlap in the covering state may largely or solely be provided in the peripheral regions of the screen segments. If the screen segments abut, the side edges of each of two adjacent or connected screen segments may be in contact with each other. If the screen segments are spaced apart from each other, slits may be present, for example, between each of two adjacent or connected screen segments. The shielding surface formed by the cover may substantially correspond to the sum of the screen surfaces of the screen segments arranged side by side. When arranged next to each other, the screen surfaces may be positioned side by side, when arranged covering each other, they may be on top of each other. When arranged covering each other, the screen segments or their screen surfaces may be arranged substantially parallel in planes that are offset with respect to each other. The side-by-side arrangement may be fan-shaped.

In order to convert the cover from its open state to the covering state, the screen segments may be movable relative to each other such that they may be transferred from the arrangement covering each other to the side-by-side arrangement in steps or continuously, and vice versa. In intermediate states, a portion of the screen segments may cover each other and another portion of the screen segments may be arranged side by side. The degree of shielding that can be achieved by arranging the screen segments next to each other may be adjusted by a user and may, for instance, also comprise partial shielding, in order to achieve partial visibility, for example, or sufficient air exchange between the air volume enclosed by the cover and the surrounding atmosphere.

The objects to be screened may be, for example, items in solid or liquid form, materials, products, and articles. The cover may shield one or more objects. The objects may, for example, be foodstuffs, prepared food, everyday items, or valuables.

The cover may serve as protection from ambient conditions such as humidity or light, from unauthorized access, from pathogens, or as a privacy screen. The cover may facilitate compliance with hygiene regulations, for example for the sanitary protection of goods in grocery stores or when serving them in restaurants, where food may be covered and exposed as needed without having to temporarily stow the cover away from the meal plate. The screen segments may be made of a material having strong thermal insulation properties or low thermal conductivity, for example of functional textiles or synthetic materials, in order to reduce the rate of heat transfer between the shielded object and the surrounding environment.

The cover may form a sealing closure, and for this purpose, may form a connection with a container or an object support surface, with the connection being impervious to at least one of liquids and gases. To this end, sealing means, such as lip seals may be provided at the edges of one or more screen segments in sections or along the entire periphery.

In the present invention, the term screen segment refers to a portion of a total screen surface in the sense of the aforementioned covering surface that is suitable for covering and shielding objects. In the covering state, the screen segments form the complete covering surface with their respective screen surfaces, or, in an intermediate state, the partial covering surface of the cover, or, in an open state, the minimal covering surface of the cover. The screen segments are curved and may, for example, have an arched shape. The screen segments may have the shape of a spherical lune (also known as a digon or spherical digon). The screen segments may be similar to a spherical lune, that is, may have a shape similar to a spherical lune. In the covering state, the screen segments may form a dome in the shape of a hemisphere or partial sphere. The screen segments may also be referred to as lamellas, because they may be movable away from and towards each other as components of a screen of a shutter-type. The screen segments may be configured with a cross section in the form of a semicircular, C-shaped or U-shaped arch. The width of the screen segments may decrease from the center of the screen segments towards the open side of the cross section. The width of the screen segments may increase or decrease along their longitudinal direction. For example, the screen segment end regions facing a container or an object support surface may have a smaller width than the screen segment portions between the end regions.

Modular connectivity refers to, for example, modular composability of screen segments, where a screen segment represents an interchangeable module of the cover. In particular, due to the modular connectivity, the total number of screen segments of the cover is not predefined, but rather, the number of interconnected screen segments may be selected freely and may be changed in arbitrary fashion. For example, a suitable number of screen segments may be chosen to realize a particular density in accordance with the current application, for example for keeping food warm or for achieving a desired air exchange, for example for storing fruits, vegetables, or bread.

In the current invention, "connectable" means "releasably connectable." Connecting and releasing of screen segments is preferably done without tools, for example by manually inserting or separating them. Two spatially adjacent screen segments may be connectable directly to each other, which does not preclude a direct or indirect connection between nonadjacent screen segments. It is advantageous to connect each of two adjacent or consecutive screen segments to each other or that these are connectable, that is, the connection is pairwise. A plurality of screen segments may thus be sequentially connected in pairs.

It is advantageous to configure the screen segments as interchangeable components. As interchangeable components, the screen segments have identical shapes and forms and are one-to-one interchangeable. This simplifies the overall design and the assembly of the cover. The screen segments may be connected to each other or arranged side by side in any order. As interchangeable components, the screen segments may be exchanged arbitrarily with other, identically configured screen segments. The interchangeability simplifies the provision and assembly of replacement parts as well. Thus, all-purpose screen segments are provided that may be assembled and released for a variety of application purposes.

It is advantageous if the screen segments have a symmetric shape or form. This simplifies the overall design and the assembly of the cover, because the screen segment may be connected to another screen segment in more than one orientation. The symmetry may, for example, be an axial symmetry of the screen segment along a central axis intersecting the screen segment.

The screen segments may, for example, be made of at least one of a fabric, a synthetic, metal, a composite material, and wood. The screen segments may be made of a biologically degradable material. The screen segments may be transparent or have a decoration for visual reasons. The screen segments may be made of a printable, laminatable, printed or laminated material, for allowing, for example, the screen segments to be personalized or the cover to be used as an advertising or promotional surface in the covering state.

It is advantageous if two interconnected screen segments are rotatably connected, which allows a relative rotation of the screen segments with respect to each other. For example, when rotatably connected, the axis of rotation may extend through the connection point of the screen segments, such that the connection allows a rotational degree of freedom. The rotary connection may, for example, be configured as a pivot joint comprising a pivot pin that is disposed at a screen segment and engages with a corresponding pivot opening of the connected screen segment, or is configured as a separate component and engages with a respective pivot opening of a screen segment. The realization of a combined rotation and translation connection is contemplated, for example by means of a link guide and a guiding pin or by means of a connection opening having a larger cross section than the connecting means engaging therein, such that the connecting means has more degrees of freedom of motion. The guide or pivot pin may be configured as a separate component of the screen segment, which may be disposed within a connection opening for establishing a connection.

The rotary connection defines a relative maneuverability of the screen segments with respect to each other, which supports the conversion of the cover from an open state to a covering state, and vice versa, as well as the hereto necessary displacement of the screen segments in a defined fashion. This does not preclude any additional connections between the screen segments that may further restrict the degrees of freedom of motion. For example, the screen segments may additionally be able to be coupled with each other at their side edge regions, for example, by means of clips, to prevent a gap from forming during the displacement or to increase the density.

When connecting multiple screen segments via rotary connections, the respective rotation or pivot axes may lie in planes that are offset from each other. This way, the screen segments' relative movements do not interfere with each other.

The screen segments may comprise one or more connection portions where they may be connected with each other. In particular, a rotary connection with an adjacent screen segment may be configured in the connection portion. For example, a connection portion may be provided in an end region of the screen segment facing a container or an object support surface or towards an open cross section of a C- or U-shaped or semicircular cross section of the screen segment. One or more of a connection opening, a slotted hole, a pivot pin, and a guiding pin may be provided in the connection portion. For example, each screen segment may include two connection portions, each facing an end portion of the screen segment. This allows connecting the screen segment to another screen segment at a total of two sides, such that the connection is more stable and a defined relative motion between the connected screen segments is possible.

In one embodiment, a first screen segment may comprise a slotted hole, into which a drive/stop pin of a second screen segment may be engaged in the connected state of the first and second screen segments. The drive/stop pin may be movably disposed within the slotted hole and may limit a relative pivoting motion between the first and second screen segments with respect to each other. After reaching a limit stop in the sense of an end position within the slotted hole, the drive/stop pin of the second screen segment may function as a driver and transfer the motion of the second screen segment onto the first screen segment. The first screen segment may also comprise a drive/stop pin which may engage with a slotted hole of another screen segment when the first screen segment is to be connected to another screen segment on the side facing away from the second screen segment. The second screen segment may also comprise a slotted hole, which a drive/stop pin of another screen segment may engage with when the second screen segment is to be connected to another screen segment on the side facing away from the first screen segment.

The first screen segment may comprise a pivot opening, in which a pivot pin of the second screen segment may be engaged in the connected state of the first and second screen segments. The pivot pin may function as a swivel for the first screen segment and may allow a relative pivoting motion of the screen segments with respect to each other. The first screen segment may also comprise a pivot pin which may engage with a slotted hole of another screen segment when the first screen segment is to be connected to another screen segment on the side facing away from the second screen segment. The second screen segment may also comprise a pivot opening, which a pivot pin of another screen segment may engage with when the second screen segment is to be connected to another screen segment on the side facing away from the first screen segment.

The screen segments may comprise an assembly opening for assembly of their respective pivot pin in the assembly opening. A pivot pin may also be disposed at a screen segment without an assembly opening, for example, glued on or configured as a single piece with the screen segment.

It is advantageous if the screen segments have a driving contour that forms a driving connection between two adjoining screen segments and allows a transfer of compressive and/or tensile forces between the screen segments. The driving connection thus allows the transfer of a motion of one screen segment onto a connected screen segment. In contrast to the aforementioned rotary connection, the driving connection is a temporarily fixed connection that may be released by force and that does not allow a relative motion of the connected screen segments within its limited local connection region, but rather transfers forces directly. The driving connection may, for example, be configured as a connection by means of clips between two connected or adjacent screen segments. The driving connection may also be realized by means of a driver opening or a slotted hole of a screen segment, and a drive pin of a connected screen segment engaged therein. The drive pin may be a separate component that may be disposed in the driver opening or the slotted hole as needed for establishing a connection. The driver opening or the slotted hole, together with the drive pin, operates as a driving connection when the drive pin comes in contact with a boundary wall of the driver opening or the slotted hole in the direction of a tensile or compressive force applied onto one of the screen segments. The driving connection may also be realized as a stop, for example, as an undercut of two successive or interconnected screen segments, when, for example, a curved edge of one of the screen segments engages behind an edge of the other screen segment. Such a driving connection allows a high density of the cover.

In principle, the driving connection may be realized by means of various types of connections that implement at least one of a form fit, frictional lock, and positive connection.

The driving connection realizes an operative mechanical connection between two adjacent screen segments, such that it is not necessary to displace each screen segment individually when actuating the cover to convert it to its open or covering state, but rather a plurality or all of the screen segments may be moved simultaneously or in a direct chronological sequence by means of the driving connection(s).

The driving connection may be disposed in a driver portion of the screen segment. The driver portion may be part of the aforementioned connection portion or may be spaced apart therefrom.

Advantageously, at least one screen segment comprises at least one connection opening for receiving a connecting element forming the pivot axis. The connection opening may be disposed in a connection portion of the screen segment, for example. The connection opening may for example be a through hole, a threaded hole, a slotted hole or a link guide in the screen segments. Connecting means, such as connecting pins, screws or rivets, may engage with the connection opening in order to form a form fit or positive connection. The connection opening may, for example, be provided for establishing a rotary or driving connection as described above. Advantageously, the screen segment may comprise a plurality of connection openings, such that a preferred connecting position for connecting to another screen segment may be selected independently and in accordance with specific requirements. This allows predefining a specific angle or a specific length of the relative motion of interconnected screen segments, depending on the position of the selected connection opening. Furthermore, this allows influencing the shape and form of the complete cover in the open or covering states and achieving a more or less large distance between the cover and a base area and thus selecting the shielding or sealing degree of the cover. In principle, a rotary or driving connection may also be realized without a connection opening in the screen segment, for example, by providing a separate fitting, such as a hinge, on the screen segment. A separately available and selectable fitting that may, for example, be glued to a screen segment, may allow a user to select a rotary or driving connection in an even more individual fashion for two screen segments that are to be interconnected.

Advantageously, at least one screen segment comprises a connecting means, preferably a pivot axis. In particular, the connecting means may form and define a pivot axis of the screen segment with respect to the pivotability of the screen segment relative to a connected, adjoining or adjacent screen segment. The connecting means may, for example, be disposed on the screen segment or formed integrally with it. The connecting means may, for example, be provided for establishing a rotary or driving connection as described above. Advantageously, the connecting means may be a pivot pin, guiding pin or drive pin. However, the connecting means may also be a screw, a rivet, a traction mechanism or a hinge, for example.

In one exemplary embodiment, a connection opening for receiving a connecting means of an adjacent, in particular in an assembly sequence subsequent screen segment, a connecting means for engaging with a connection opening of an adjacent, in particular in an assembly sequence preceding screen segment, and a guide for receiving a driver may each be disposed in one screen segment, for example.

Advantageously, at least one screen segment is provided with a stop. The stop allows limiting the movement of the screen segments with respect to each other. The stop may simultaneously also function as a driver of an aforementioned driving connection, because a relative motion of the screen segments is only possible up to the stop and thereafter, the stop acts like a fixed connection which is suitable for transferring a tensile or compressive force between the two connected screen segments. The stop may for example be a slotted hole, in which a stop pin for limiting a relative displacement of screen segments with respect to each other may be placed. The stop pin may, for instance, be disposed on a screen segment or may be provided as a separate component that may be connected to a screen segment as needed. The stop may also be a curved edge of the screen segment which engages behind an edge of another screen segment and the thus formed undercut limits the relative displacement of screen segments with respect to each other.

Advantageously, the cover comprises a base to which at least one of the screen segments may be or is connected. This increases the stability of the cover. In addition, for example, a screen segment connected to the base may be fixed in its position, that is, it may not be movable relative to the base, whereas other screen segments may be movable relative to the base. This allows fixing a screen segment as a base screen segment that is not spaced apart or displaced from the container or the object support surface and defines a minimal shielding surface or also the resting position of the screen segments covering each other in the open state of the cover. In principle, one, more, or all of the screen segments may be or are connected to the base, where the connection between the screen segment and the base allows or does not allow a relative motion of the screen segments, selectively and depending on the type of connection. For example, a fixed screw connection or a pivot pin connection may be provided between a screen segment and the base. The base may be integral with a container or an object support surface or may be disposed thereon. The base may be a foot component or a multi-part foot. The base may be positionable in the spatial vicinity of the object for shielding it and comprise, for example, one or more pedestals or supporting surfaces.

It is advantageous to configure the cover as a foldable and again unfoldable fan cover, wherein the cover comprises a plurality of screen segments that may be or are connected in modular fashion, of which each of two adjacent screen segments are connected or connectable via a rotary connection. In this way, a simple, easy to assemble, intuitive to use, and inexpensive embodiment of the invention is provided. Due to the modularity of the cover, a plurality of screen segments is advantageous, where a plurality refers to at least three screen segments, where two adjacent screen segments are each connectable or connected with each other, that is, pairwise, by means of an individual connection, via a rotary connection.

Actuation of the cover for converting it from an open state into a covering state or vice versa may be effected manually and/or by means of a mechanical or electrical drive. For example, a screen segment may be grasped by hand and a tensile or compressive force may be applied in order to displace the screen segment and any other screen segments connected thereto. Here it may be advantageous, if one, more or all of the screen segments each comprise a recessed grip to facilitate grasping and pivoting the screen segments. Additionally, an actuator may be provided that transfers an actuation onto the cover without direct contact of the user with a screen segment, for example, via an actuation screw for generating a folding or unfolding motion of the screen segments. An actuator may have sanitary advantages, because contact with the screen segments is avoided.

The screen segments may, for example, be manufactured by injection molding to enable cost-effective production. Furthermore, manufacturing by means of an additive manufacturing process may be considered, for example, to enable a flexible manufacturing process.

The cover may comprise a lock in order to deny or allow access to the shielded object, selectively and depending on authorization.

The object of the invention is also achieved by providing a container comprising a base plate and a cover according to any one of the features described above. This provides a unit that is ready for use to temporarily shield an object without requiring an object support surface, for example, for storing or placing the object. In principle, the container may have any conceivable shape and consistency. In addition to the base plate, the container may comprise side walls. The base plate may, for example, be round or angled and may have length and width dimensions that are larger than its height. The base plate may comprise an object receptacle for placing the object to be shielded. The base plate may comprise baffles for covering or protecting, for example, the connecting regions of the screen segments. The base plate may comprise handle portions for transporting the container. A base of the cover may, for example, be disposed on the base plate or formed integrally with it.

The base plate may comprise a latch for attaching at least one screen segment. The latch may allow positioning the cover, for example, on the base plate selectively or as needed, in order to form a unit that is ready for use. The latch may also serve to fix the cover in an open or covering state and thus to secure the cover against involuntary pivoting. This facilitates, for instance, the transport of the container or allows, for example, a reliable insulation of the objects contained within the container. The latch is easily releasable for disassembly of the container, for example, for storage or cleaning purposes, and comprises, for example, a spring latch mechanism for this purpose. Advantageously, the base plate comprises a plurality of latches, for example two latches, that are arranged in opposite regions of the base plate. This allows using one of the latches for basic fastening of the cover on the base plate and another latch for selectively fastening the cover on the base plate in a covering state of the cover.

The base plate may have a sealing edge that allows the cover to form a sealing enclosure of the volume enclosed by the cover in the covering state. The container may be, for example, a food container, a serving container or a storage container for everyday items or valuables.

Advantageously, the base plate comprises an assembly base for attaching the cover. This allows connecting the cover to the base plate in a defined fashion, for example, by force- or form-fittingly and preferably releasably attaching the cover to the assembly base. The attachment of the cover to the assembly base may, for example, be done by screwing, latching or clipping, and with or without additional connecting means. The assembly base may, for example, be configured as a bottom base and may thus be disposed on the support surface of the base plate. The assembly base may, for example, be configured as a lateral base and may thus be disposed at an edge of the base plate. The assembly base may be formed integrally with the base plate.

It may further be advantageous, if the assembly base comprises a guiding groove for guiding a guide pin connected to a screen segment. This allows the guide pin connected to a screen segment to engage with the guiding groove, and thus allows defining a path of motion of the screen segments in the sense of a trajectory. The guiding groove may, for example, be embodied as a link guide. The guiding groove may comprise a curved, for example, semicircular guide path. The guiding groove may be disposed on a side of the assembly base facing the interior of the container. The guiding groove facilitates the conversion of the cover from the open state into the covering state. The guide pin may, for example, be insertable into a pivot opening or any other appropriate opening of the screen segment. The guiding groove may comprise a plurality of narrowings of the guiding cross section to define specific intermediate positions when converting the cover from an open state to the covering state or vice versa. In this case, the guide pin may have to overcome a slight resistance at the narrowings of the cross section to traverse the defined intermediate positions and is self-retainingly held without force at an intermediate position. Alternatively or additionally, the guiding groove may comprise retaining recesses to define intermediate positions into which the guide pin falls by the force of gravity and remains in self-retaining fashion, until it is guided further through the guiding groove by an applied force. Furthermore, it is conceivable to replace the guide pin with a guide pulley. The guiding components, such as guiding groove, guide pin and/or guide pulley may, for example, be made of a friction bearing material such as polyoxymethylene (POM) to facilitate the guiding and thus the handling of the cover.

The assembly base may further comprise an assembly guide that is shaped like a groove and, for example, formed between an edge and a guiding groove. A cover including a guide pin may be inserted into the assembly base via the assembly guide until the guide pin reaches the guiding groove, and it may be removed again therefrom for disassembly. Further, it is conceivable that the assembly base protrudes obliquely, that is, not perpendicularly, from the base plate on order to allow space-saving stackability of base plates on top of each other.

Advantageously, the container comprises a handle mount for attaching a handle element to the container. This enables a releasable attachment of a handle element as a transport handle for facilitating the transport of the container. The handle mount may, for example, be a latch opening, into which the handle element is locked by means of a locking catch. However, the handle mount may also be a recess with which a handle tab form-fittingly engages without latching. For this purpose, the handle element may, for example, have flexibility whereby the handle tab is pressed into the handle mount when lifting the handle element and released from the handle mount through associated spreading of the handle element when it is lowered. It is additionally conceivable that the handle element may be connected to the screen segment in such a way that it forms an actuator for converting the cover from an open state to a covering state or vice versa. The handle element may further comprise a comfortable handle portion, for example, with padding or bellows for a more comfortable grip feeling.

The container or its individual components, such as the base plate, may, for example, be made of at least one of a fabric, a synthetic, metal, a composite material, and wood. Additionally, the container may comprise interchangeable inserts for providing a suitable support surface for different types of objects. Thus, a padded insert may be provided for storing a valuable item, or an insert made of a cut resistant material such as wood or a synthetic material may be provided for storing and cutting of food, such as cakes. The insert may also be made of a heat storing, heat insulating material, heat removing or heat supplying material, for example silica gel, or may comprise a chemical latent heat accumulator.

The container or its individual components may, for example, be manufactured by injection molding to enable cost-effective production. Furthermore, manufacturing by means of an additive manufacturing process may be considered, for example, to enable a flexible manufacturing process.

The container may, for example, comprise a temperature control element or a receptacle for a temperature control element in the region of the base plate for manipulating the temperature within the container volume. The temperature control element may, for example, be a heating element or a thermal pack.

The object of the invention is also achieved by means of a method for assembling a domed cover for temporarily shielding objects, where the cover may be converted from an open state exposing the object to a closed covering state covering the object and vice versa. The method comprises the steps of:

- providing a total number of curved screen segments of the cover
- selecting a number in accordance with specific requirements from the total number of screen segments
- modularly connecting the selected number of screen segments with each other such that these are at least pairwise movable about a common pivot axis and form a domed cover for shielding the object when in a side-by-side covering state.

This provides for a simple and intuitive method for installing a cover for temporarily shielding objects. At all times, as needed or in accordance with requirements, for example, as a reaction to a required density or shielding surface of the cover, a user may select a specific number of screen segments for the intended screen and interconnect them. The user may install and disassemble the modularly connectable screen segments at will and may, in particular, quickly and simply exchange damaged screen segments. In particular, the method may be configured for installing a cover according to any one of the aforementioned features or in accordance with any one of claims 1 to 10. For example, the interconnected screen segments of the method may be embodied as interchangeable components.

Advantageously, in the method, the cover is releasably connected to a container comprising a base plate. This provides a unit that is ready for use to temporarily shield an object. It is advantageous if the cover is releasably connected to the base plate via an assembly base. This allows connecting the cover to the base plate in a defined fashion.

Generally, in the context of the present application, the words "a/an", unless explicitly defined otherwise, are not to be understood as a numeral word, but as indefinite articles with the literal sense of "at least one".

BRIEF DESCRIPTION OF THE DRAWINGS

The invention will be explained in more detail below by means of an exemplary embodiment together with the accompanying drawings. These show schematically.

DETAILED DESCRIPTION OF THE INVENTION

Figure 1:
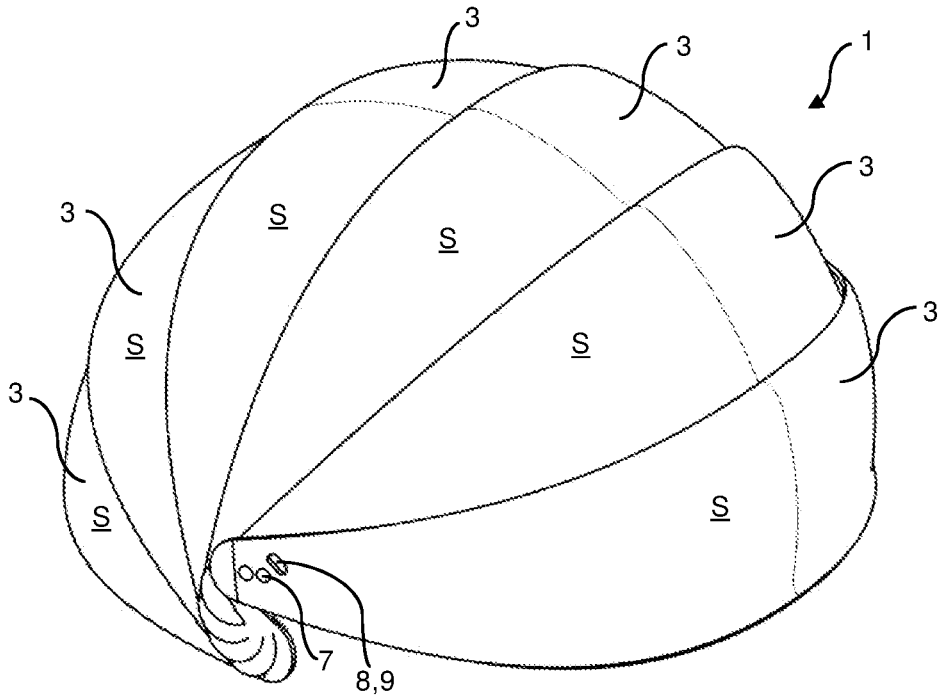
FIG. 1 a perspective view of a first embodiment of the cover in a covering state.
Figure 2:
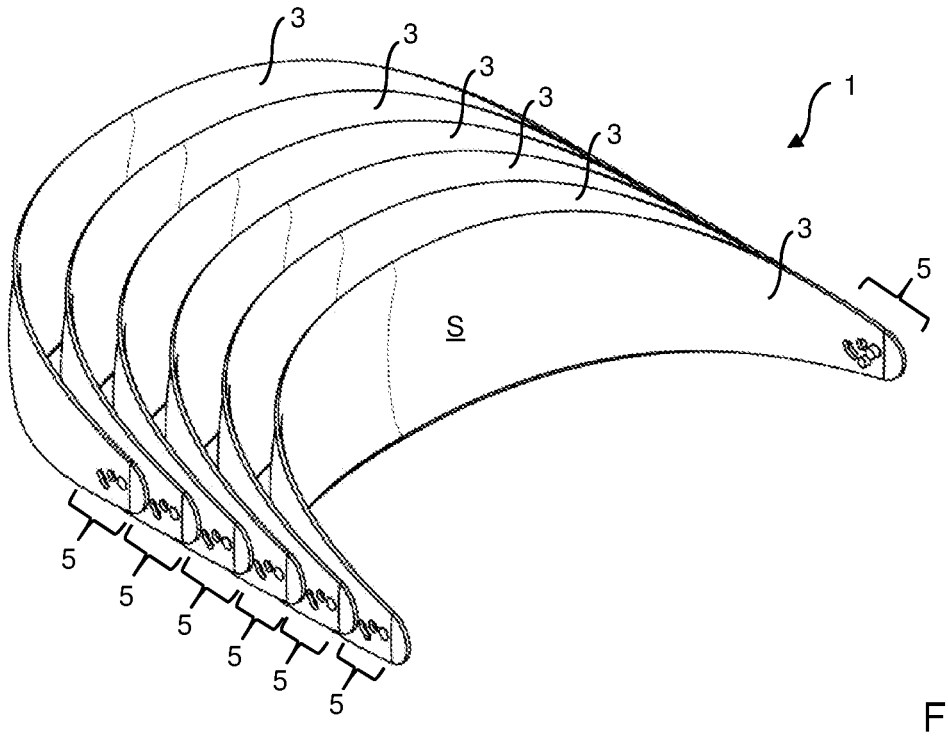
FIG. 2 a perspective view of the first embodiment of the cover in an open state.

FIGS. 1 and 2 illustrate a first embodiment of cover 1 in a covering state and an open state, respectively. The cover 1 comprises a plurality of interconnected curved screen segments 3, which are arranged side by side in the covering state of the cover 1 illustrated in FIG. 1 and which cover each other in the open state of the cover 1 shown in FIG. 2. The screen segments 3 each span a screen surface S at their bottom and top sides, where the sum of the screen surfaces S forms a covering surface of the cover 1 for temporarily shielding an object 2 depicted in FIG. 10. The screen segments 3 are each connected with an adjacent or subsequent screen segment 3 at a connection portion 5, that is, successively coupled with each other. Shown are two connection portions 5 at a respective screen segment 3, where the connection portions 5 are facing the respective end regions of a screen segment 3 that has the arcuate shape of a type of circular lune. A rotary connection 7 and a driving connection 8 with a stop 9 are each provided in the connection portions 5, as will be described in more detail with respect to FIG. 3, for example.

The screen segments 3 that are arranged side by side in the covering state form a type of dome that allows shielding an object 2 underneath the cover 1, for example, from ambient conditions. The modular connectivity of the cover 1 comprising a plurality of selectively interconnectable screen segments 3, which are shown in FIGS. 1 and 2 as symmetric, interchangeable components, facilitates the assembly and handling of the cover 1, and the cover 1 may be adapted for individual current requirements for shielding the object 2. In addition, the cover 1 may remain at its point of use by partial or full conversion of the cover 1 from an open state to a covering state, without having to lift the cover completely off the object.

Figure 3:
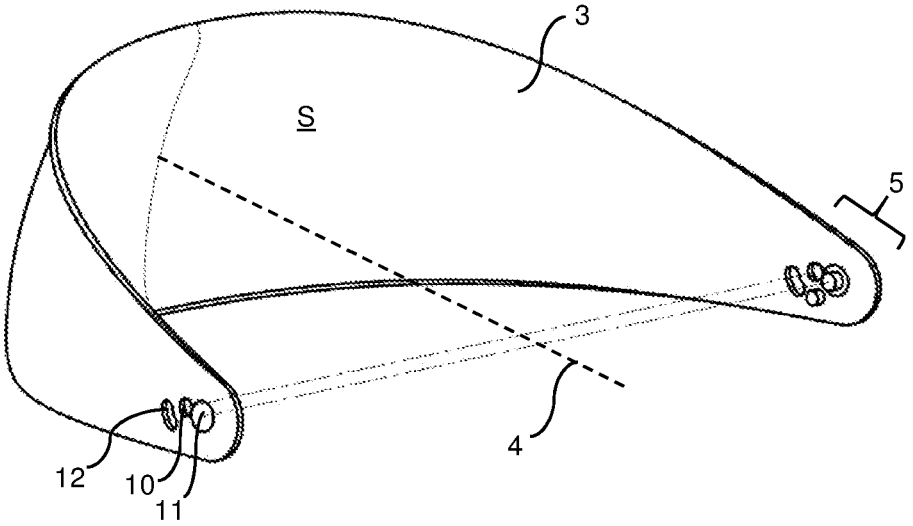
FIG. 3 a perspective view of an embodiment of a screen segment of the cover.

FIG. 3 shows an exemplary screen segment 3 that may be assembled in modular fashion with other screen segments 3 to form the cover 1. The screen segment 3 is designed symmetrically to facilitate handling, assembly, and exchange of the screen segments 3, whereby the axis of symmetry 4 intersects the screen segment 3 in the center of the screen segment 3. FIG. 3 shows, among other things, that the width of the screen segments 3 becomes narrower from the center of the screen segment 3 towards its end regions or connection portions 5, in order to maintain the maneuverability of several connected screen segments 3 with respect to each other. A pivot opening 10 for receiving a pivot pin 11 of an adjacent, in particular in an assembly sequence subsequent screen segment 3, a pivot pin 11 for engaging with a pivot opening 10 of an adjacent, in particular in an assembly sequence preceding screen segment 3, and an arcuate slotted hole 12 for receiving a drive/stop pin, which is not shown, are disposed in each connecting portion 5. Here, the pivot opening 10 and the slotted hole 12 may be considered a connection opening, and the pivot pin 11 as well as the drive/stop pin that is not shown may be considered connecting means.

Figure 4A:
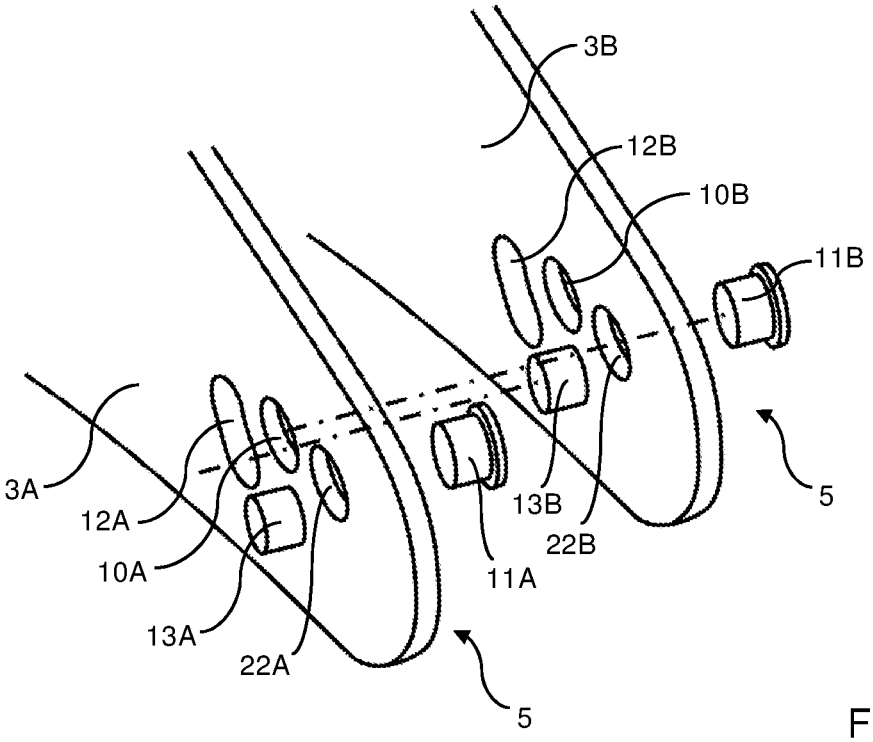
FIGS. 4A-C detailed perspective views of two screen segments to be interconnected with each other.
Figure 4B:
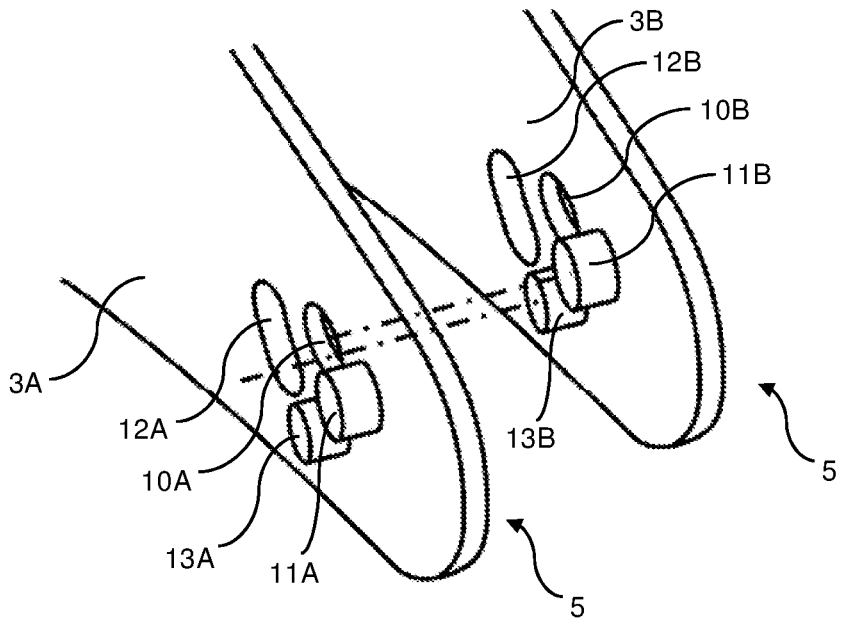
Figure 4C:
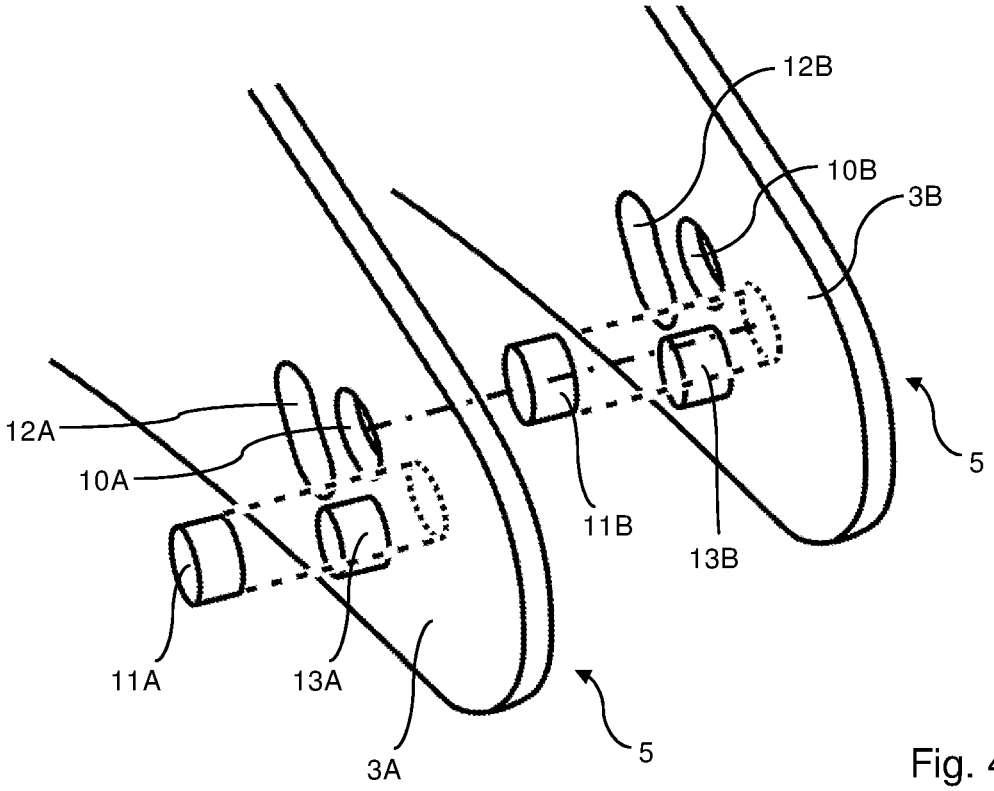

FIGS. 4A, 4B, and 4C each illustrate a first screen segment 3A and a second screen segment 3B that may be interconnected. The first screen segment 3A and the second screen segment 3B are embodied as interchangeable components and are interchangeable with respect to order, shape, and structure and have the same construction. The first screen segment 3A may comprise a slotted hole 12A, in which a drive/stop pin 13B of the second screen segment 3B is engaged in the connected state of the first screen segment 3A and the second screen segment 3B. The drive/stop pin 13B is displaceably disposed in the slotted hole 12A and limits a relative pivoting motion of the screen segments 3A, 3B with respect to each other. After reaching a limit stop in the sense of an end position within the slotted hole 12A, the drive/stop pin 13B functions as a driver and may transfer motion of the second screen segment 3B onto the first screen segment 3A. The first screen segment 3A also comprises a drive/stop pin 13A, which may engage with a slotted hole of another screen segment, not shown, when the first screen segment 3A is to be connected to another screen segment on the side facing away from the second screen segment 3B. The second screen segment 3B also comprises a slotted hole 12B, which a drive/stop pin of another screen segment, not shown, may engage with when the second screen segment 3B is to be connected to another screen segment on the side facing away from the first screen segment 3A.

The first screen segment 3A comprises a pivot opening 10A, in which a pivot pin 11B of the second screen segment 3B is engaged in the connected state of the first screen segment 3A and the second screen segment 3B. The pivot pin 11B functions as a swivel for the first screen segment 3A and allows a relative pivoting motion of the screen segments 3A, 3B with respect to each other. The first screen segment 3A also comprises a pivot pin 11A, which may engage with a slotted hole of another screen segment, not shown, when the first screen segment 3A is to be connected to another screen segment on the side facing away from the second screen segment 3B. The second screen segment 3B also comprises a pivot opening 10B, which a pivot pin of another screen segment may engage with, not shown, when the second screen segment 3B is to be connected to another screen segment on the side facing away from the first screen segment 3A.

FIG. 4A illustrates that the first screen segment 3A comprises an assembly opening 22A for installing the pivot pin 11A within the assembly opening 22A and that the second screen segment 3B comprises an assembly opening 22B for installing the pivot pin 11B within the assembly opening 22B. FIG. 4B shows the pivot pins 11A, 11B in an already installed state. FIG. 4C illustrates the pivot pins 11A, 11B disposed on the screen segments without an assembly opening 22A, 22B, for example, glued on or formed integrally with the segments.

Figure 5:
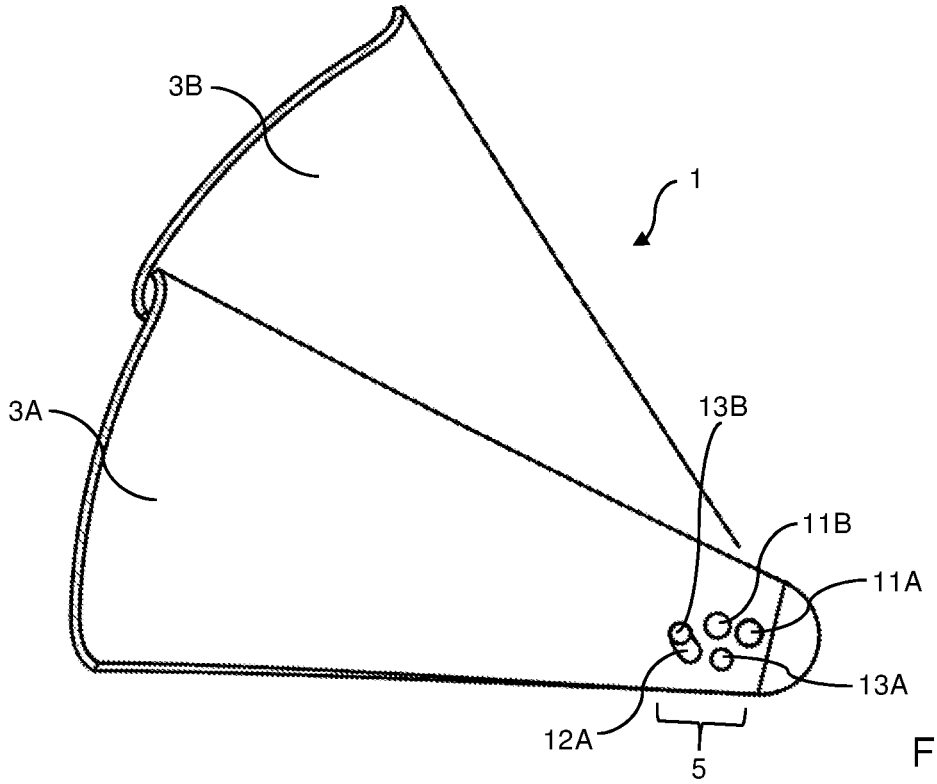
FIG. 5 a side view of two interconnected screen segments.

FIG. 5 shows the two screen segments 3A, 3B in an interconnected state. The side view illustrates, how the drive/stop pin 13B of the second screen segment 3B engages with the slotted hole 12A of the first screen segment 3A, the pivot pin 11B of the second screen segment 3B engages with the pivot opening 10A of the first screen segment 3A, and the pivot pin 11A and the drive/stop pin 13A of the first screen segment 13A are available for connecting to another screen segment that is not shown.

Figure 6:
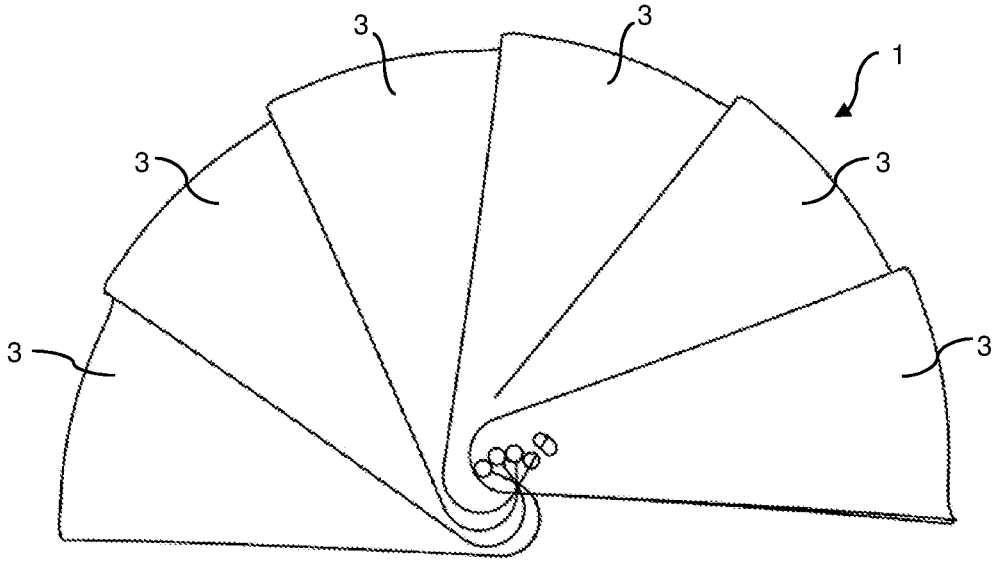
FIG. 6 a side view of six interconnected screen segments.

FIG. 6 depicts a plurality of, here six, screen segments 3 interconnected according to the aforementioned principle.

Figure 7:
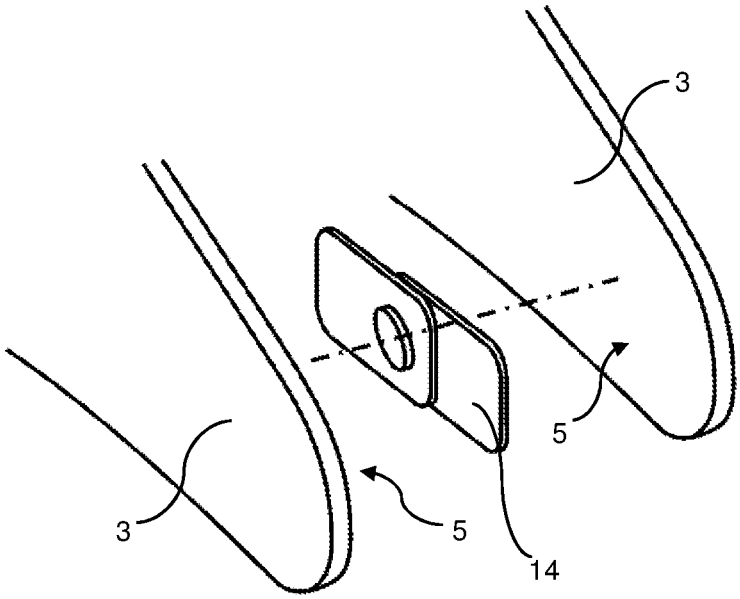
FIG. 7 a detailed perspective view of another embodiment of two screen segments to be interconnected with each other.

FIG. 7 illustrates a variant, where the screen segments 3 do not comprise any connection openings or means, but may be connected by means of a fitting 14. The fitting 14 may, for example, be glueable to the screen segments 3 and allows a more individual specification, how the screen segments are to be interconnected, for example by means of a rotary or driving connection.

Figure 8:
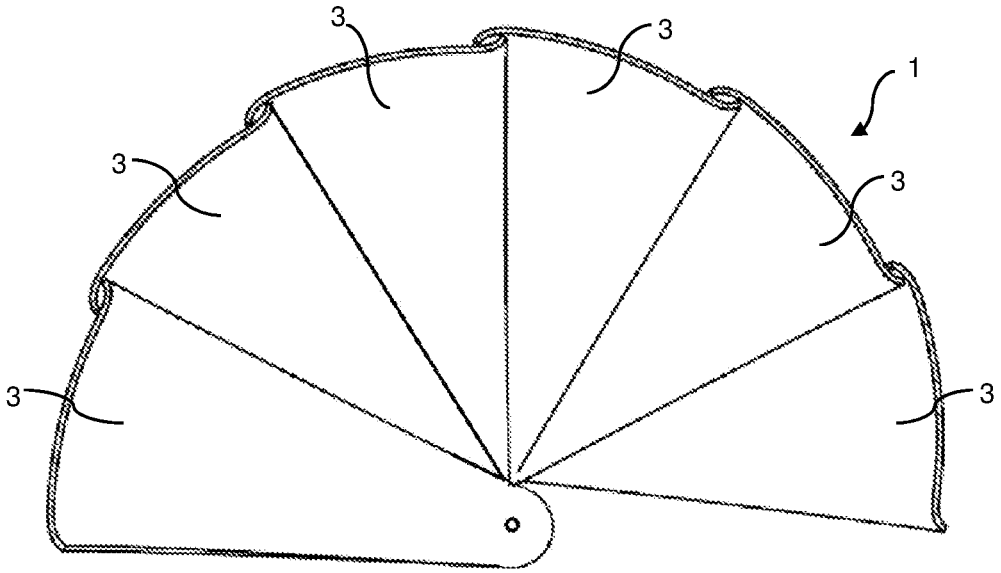
FIG. 8 a side view of a second embodiment of the cover in a covering state.
Figure 9:
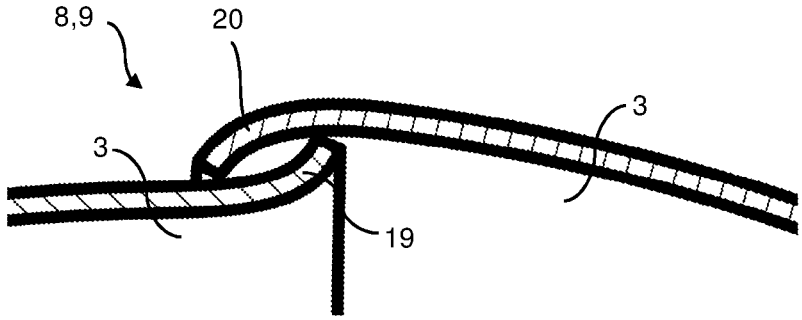
FIG. 9 a detailed side view of the second embodiment.

FIG. 8 illustrates another embodiment of the cover 1 in a covering state, where each screen segment 3 is displaced with respect to the adjoining screen segment 3, and thus the screen segments 3 are arranged side by side. The screen segments 3 each have a front edge 19 that is curved upwards and a rear edge 20 that is curved in the opposite direction, that is, downwards, as shown in detail in FIG. 9. A relative motion of the screen segments 3 is limited by an undercut of the front edge 19 with the rear edge 20, such that a stop 9 is realized. At the same time, the stop 9 forms a driving connection 8 between the screen segments 3, such that, after reaching stop 9, a tensile force acting onto a screen segment 3 is transferred onto the subsequent screen segment 3 via the driving connection 8, which in turn moves relative to its subsequent screen segment 3, until its stop 9 is reached, etc. This way, the covering state shown in FIG. 8 is achieved, with completely unfolded screen segments 3 that are arranged side by side, where one can see the fan-shaped hood-like arrangement of the screen segments 3.

Figure 10:
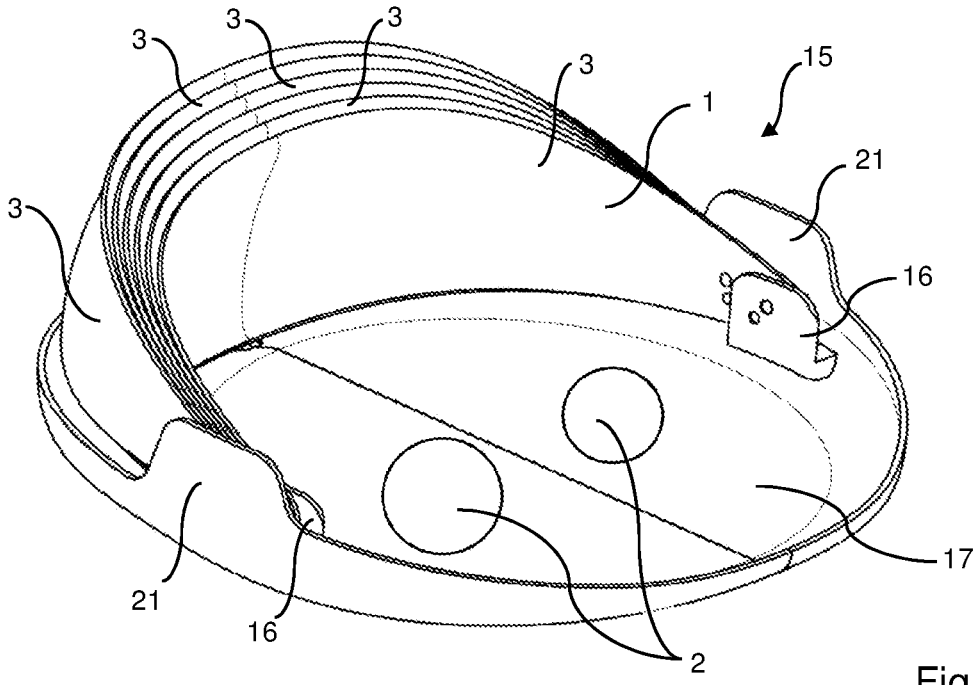
FIG. 10 a perspective view of a first embodiment of a container comprising a base plate and a cover in an open state.
Figure 11:
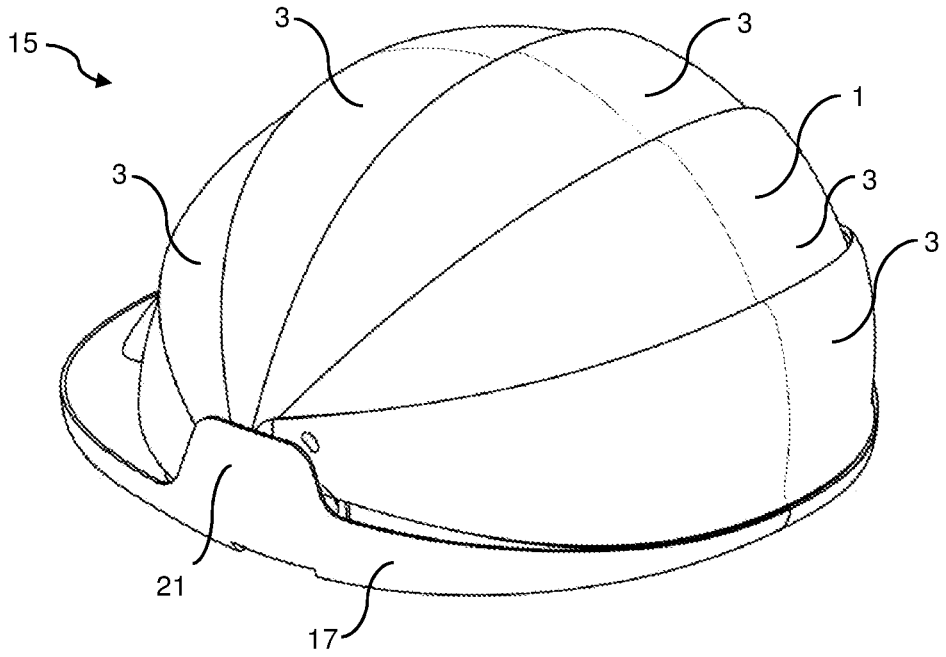
FIG. 11 a perspective view of the container of FIG. 10 comprising a base plate and a cover in a covering state.

FIGS. 10 and 11 illustrate a first embodiment of a container 15 comprising a base plate 17 and a cover 1, in an open state (FIG. 10) and a covering state (FIG. 11) for temporarily shielding objects 2, respectively. The cover 1 comprises an assembly base embodied as a bottom base 16 disposed on a support surface of the base plate 17 comprising connection openings for establishing a connection to at least one of the screen segments 3, where the connection is fixed or allows relative motion.

The base plate 17 has an object support surface for supporting the objects 2 to be shielded as well as integrally formed baffles 21 for visual concealment and for protection of the connection portions 5 of the screen segments 3. At the same time, the baffles 21 may serve as handle portions or may comprise handle mounts for an optional additional handle element for transporting the container 15. The container 15 is a unit that is ready for use to temporarily shield the objects 2 without requiring an object support surface, for example, for storing or placing the objects 2. In addition, the objects 2 may be transported within the container 15.

Figure 12:
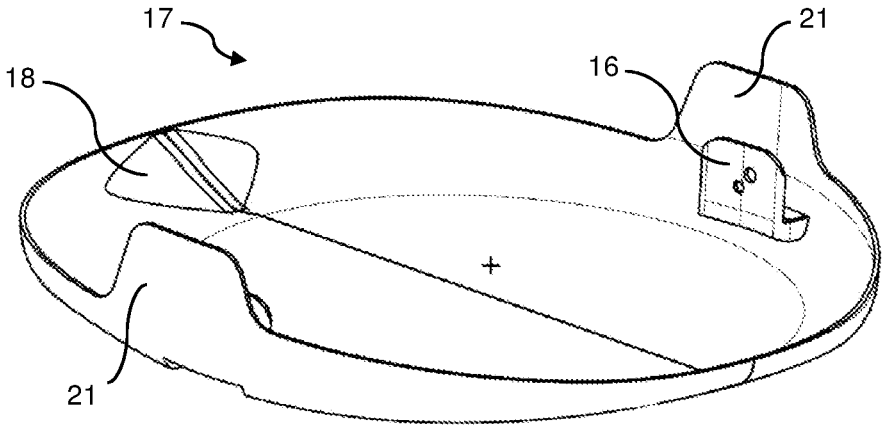
FIG. 12 a perspective view of the base plate of the container of FIG. 10.

FIG. 12 shows that the base plate 17 comprises a latch 18. The latch 18 allows to temporarily or permanently attach one, more or all of the screen segments 3 to the base plate 17, for example, in order to facilitate the conversion of the cover 1 from an open state into a covering state. For example, this allows displacing the screen segments 3 without having to pay attention to an exact metering of the tensile force when unfolding the cover 1, so as to not lift the last screen segment 3 from the base plate 17 and thereby generate an undesired gap between the cover 1 and the base plate 17. Optionally, an additional latch, not shown, may be provided opposite the latch 18 to allow fastening of at least an additional screen segment 3 in a covering state of the cover. By fastening the screen segments 3 by means of the latch 18, or where appropriate by means of the latch 18 and another latch, inadvertent or accidental conversion of the screen segments 3 to the open or the covering state, for example due to gravity when tilting the container, may be avoided.

Figure 13:
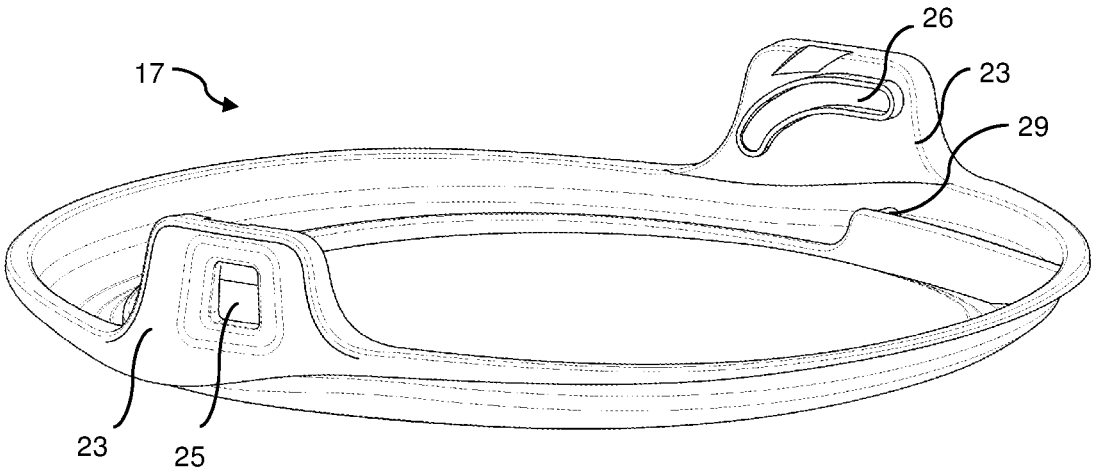
FIG. 13 a perspective view of a base plate of a container according to a second embodiment of the container.

FIG. 13 illustrates a base plate 17 of a container 15 according to a second embodiment of the container 15. In this embodiment, the base plate 17 comprises an assembly base that is formed as a lateral base 23 integrally with the base plate 17 and arranged at its edge. The lateral base 23 formed of two opposite lateral tongues of the base plate 17 comprises at least on one side an arcuate guiding groove 26 facing the interior of the container for receiving a guide pin 27 shown in FIG. 14 and connected to a screen segment 3. The lateral base 23 also comprises an external handle mount 25 on both sides facing away from the container interior, with which handle tabs 30 of a handle element 24 shown in FIG. 15 may engage to attach the handle element 24 to the base plate 17 and thus to the container 15. The base plate 17 shown in FIG. 13 comprises additionally a base segment receptacle 29 for attaching a screen segment 3 and for forming an axis of rotation for this screen segment 3. For this purpose, at least one screen segment 3 comprises a recess 28 shown in FIG. 14, such that the screen segment 3 may at least sectionally enclose the base segment receptacle 29.

Figure 14:
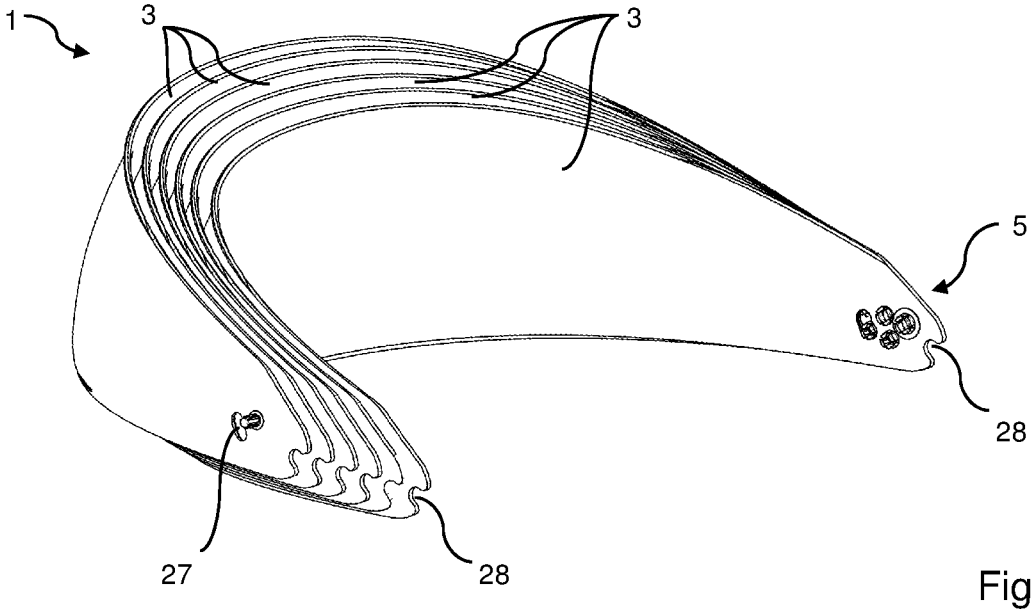
FIG. 14 a perspective view of six interconnected screen segments of a container according to the second embodiment of the container.

FIG. 14 illustrates a cover 1 designed for assembly on the base plate 17 shown in FIG. 13. In this exemplary embodiment, the cover 1 is formed by six screen segments 3 that are pairwise interconnected in a connection portion 5 and is shown in an open state, where the screen segments 3 cover each other almost completely. At the outer screen segment 3, which encloses the other screen segments 3 to a large extent, a guide pin 27 is provided, for example inserted into an appropriate opening of the screen segment 3, for engaging with a guiding groove 26 shown in FIG. 13.

Figure 15:
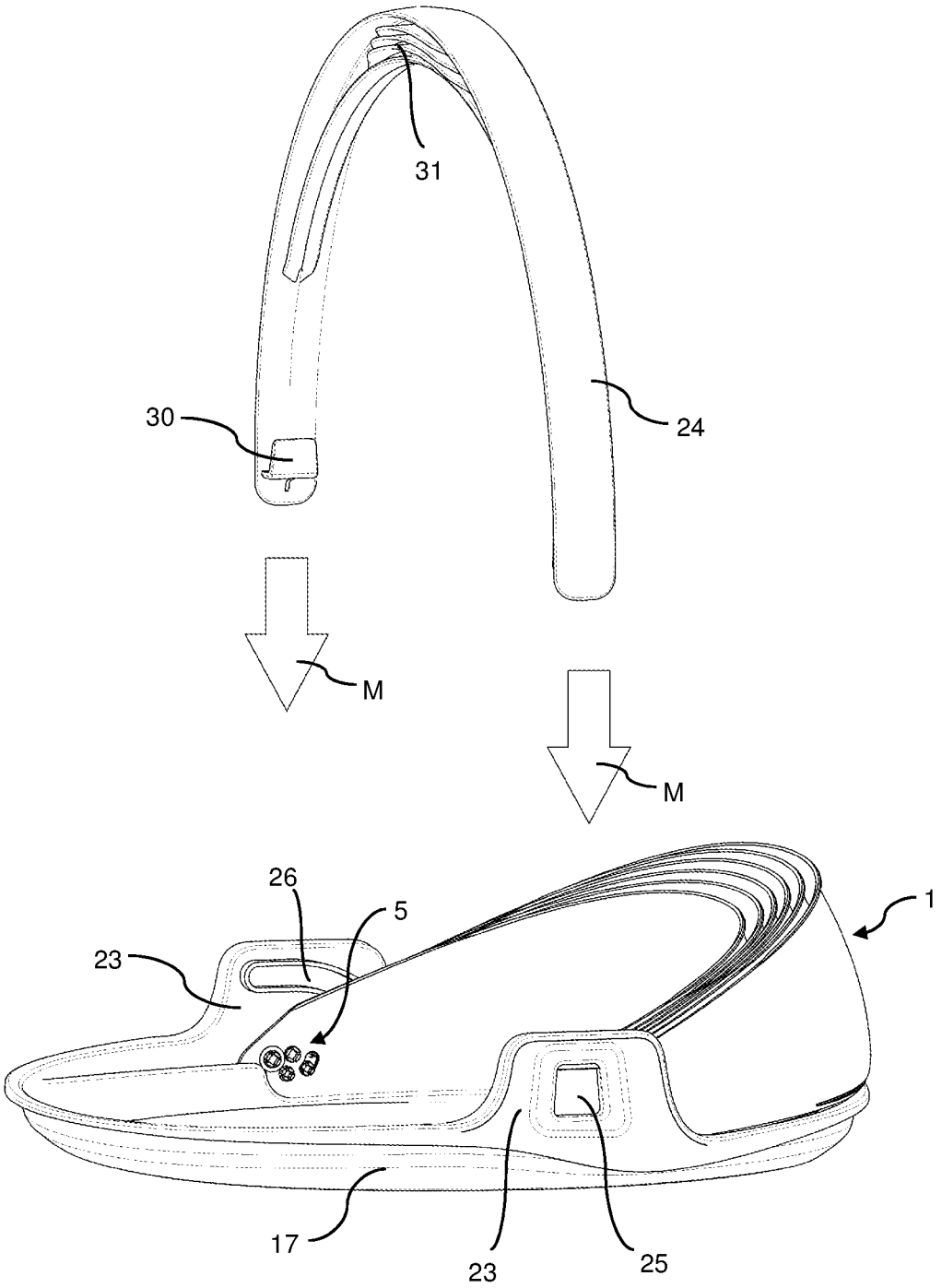
FIG. 15 a perspective view of the container according to the second embodiment, comprising a base plate, screen segments, and a handle element that may optionally be connected to the container.
Figure 16:
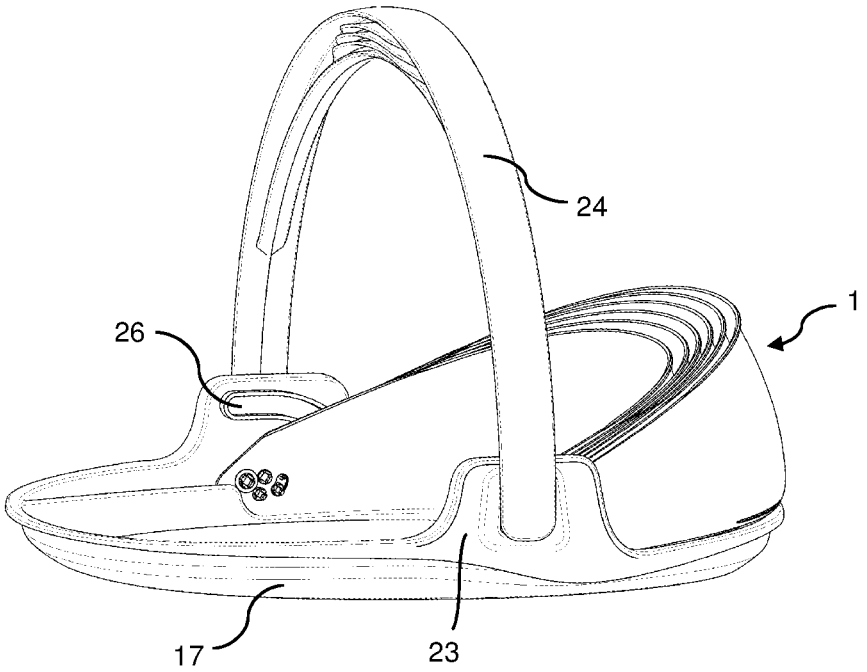
FIGS. 16-19 a perspective view of the container according to the second embodiment, comprising the base plate, screen segments, and the handle element in various transitional states of the cover from an open state (FIG. 16) to a covering state (FIG. 19).
Figure 17:
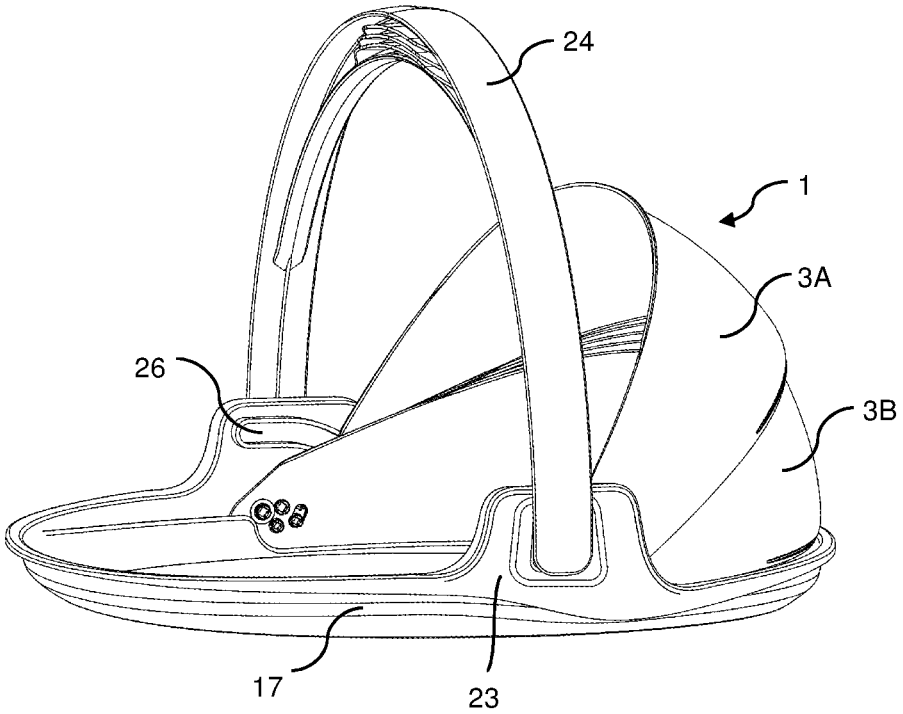
Figure 18:
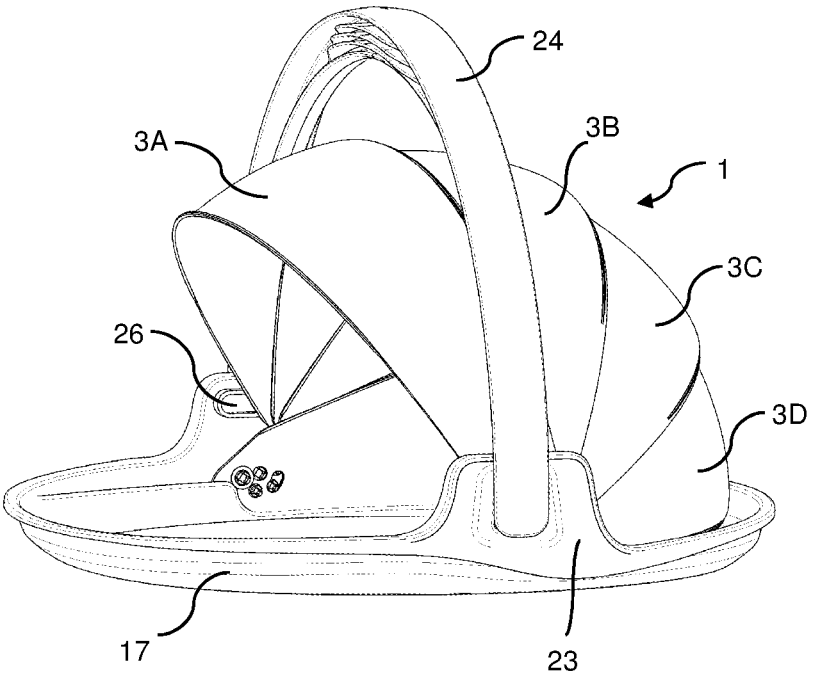

FIG. 15 illustrates the cover 1 shown in FIG. 14 in a state connected with the base plate 17 of FIG. 13. Furthermore, one can see that a handle element 24 is movable in the assembly direction M towards the base plate 17, in order to insert the handle tabs 30 of the handle element 24 into associated handle mounts 25 of the base plate 17 for attachment. The handle tabs 30 are temporarily hooked into the handle mounts 25 in a form-fitting manner, but may be released again by lowering and thus spreading of the handle element 24, such that a connection and release of the handle element 24 and the base plate 17 is possible without tools. The handle element 24 comprises a comfortable handle portion 31 which is configured as a bellows and may thus allow widening and dampening of the handle.

Figure 19:
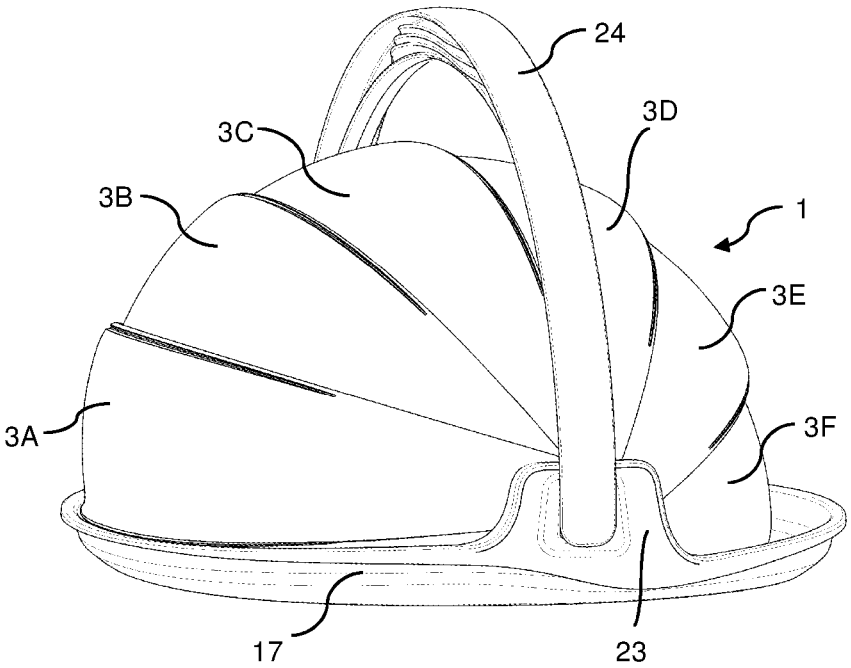

FIGS. 16 to 19 show a perspective view of the container 15 according to the second embodiment, comprising the base plate 17, the screen segments 3A to 3F, and the handle element 24 in various transitional states of the cover 1 from an open state (FIG. 16) to a covering state (FIG. 19). It becomes clear how a dome-shaped cover 1 for protecting objects 2 is provided by pivoting the interconnected screen segments 3A to 3F in series.

LIST OF REFERENCE NUMERALS

1 cover
2 object
3 screen segment
3A first screen segment
3B second screen segment
3C third screen segment
3D fourth screen segment
3E fifth screen segment
3F sixth screen segment
4 axis of symmetry
5 connection portion
6 driver portion
7 rotary connection
8 driving connection
9 stop
10 pivot opening
10A pivot opening of first screen segment
10B pivot opening of second screen segment
11 pivot pin
11A pivot pin of first screen segment
11B pivot pin of second screen segment
12 slotted hole
12A slotted hole of first screen segment
12B slotted hole of second screen segment
13 drive/stop pin
13A drive/stop pin of first screen segment
13B drive/stop pin of second screen segment
14 fitting
15 container
16 bottom base
17 base plate
18 latch
19 front edge
20 rear edge
21 baffle
22 assembly opening for pivot pin
22A assembly opening of first screen segment
22B assembly opening of second screen segment
23 lateral base
24 handle element
25 handle mount
26 guiding groove
27 guide pin
28 recess
29 base segment receptacle
30 handle tab
31 comfortable handle portion
S screen surface
M assembly direction

What is claimed is:

1. A cover for temporarily shielding objects that may be converted from an open state exposing the object to a closed covering state covering the object and vice versa, wherein the cover comprises at least three modularly interconnectable or interconnected curved screen segments that are interconnected in a group, wherein the screen segments of the group have a driving contour that forms a driving connection between two adjoining screen segments of the group and allows a transfer of at least one compressive and tensile forces between the screen segments of the group, and wherein the screen segments of the group being pairwise movable about a common pivot axis relative to each other, wherein the pivot axes of adjacent pairs of interconnected screen segments of the group lie in planes that are offset from each other, wherein the pivot axes of different pairs of interconnected screen segments lie in planes that are offset from each other, wherein the screen segments, in the open state of the cover, are covering one another and, in the covering state of the cover, overlap each other, abut against each other, or are spaced apart from each other side by side such that they form a domed cover.

2. The cover according to claim 1, wherein the screen segments are configured as interchangeable components.

3. The cover according to claim 1, wherein two interconnected screen segments are rotatably connected, which allows a relative rotation of the screen segments with respect to each other.

4. The cover according to claim 1, wherein at least one of the screen segments comprises at least one connection opening for receiving a connecting element that forms the pivot axis.

5. The cover according to claim 1, wherein at least one of the screen segments comprises at least one connection means, in particular a pivot axis.

6. The cover according to claim 1, wherein at least one screen segment comprises at least one of a slotted hole, a pivot opening, a pivot pin, and a drive/stop pin.

7. The cover according to claim 1, wherein at least one of the screen segments comprises a stop.

8. The cover according to claim 1, wherein the cover comprises a base to which at least one of the screen segments may be or is connected.

9. The cover according to claim 1, wherein the cover is configured as a foldable and unfoldable fan-like cover, wherein the cover comprises a plurality of screen segments that may be or are connected in modular fashion, of which each of two adjacent screen segments are connected or connectable via a rotary connection.

10. A cover for temporarily shielding objects that may be converted from an open state exposing the object to a closed covering state covering the object and vice versa, wherein the cover comprises at least three modularly interconnectable or interconnected curved screen segments of similar symmetric shape forming Interchangeable components each comprising a first and a second pivot element on each side arranged offset to each other, wherein at least three of these screen segments are interconnected in a group, wherein the screen segments of the group have a driving contour that forms a driving connection between two adjoining screen segments of the group and allows a transfer of at least one of compressive and tensile forces between the screen segments of the group, and wherein the screen segments of the group being pairwise movable about a common pivot axis relative to each other, wherein the first pivot element of a screen segment interacts with the offset second pivot axis of the adjacent screen segment to provide an pivot axes of adjacent pairs of interconnected screen segments of the group lying in planes that are offset from each other, wherein the screen segments, in the open state of the cover, are covering one another and, in the covering state of the cover, overlap each other, abut against each other, or are spaced apart from each other side by side such that they form a domed cover.

* * * * *